US005887915A

United States Patent [19]

Ramsauer

[11] Patent Number: 5,887,915

[45] Date of Patent: Mar. 30, 1999

[54] ROD-TYPE CLOSURE

[76] Inventor: Dieter Ramsauer, Am Neuhauskothen 20, D-42555 Velbert, Germany

[21] Appl. No.: 809,647

[22] PCT Filed: Sep. 23, 1995

[86] PCT No.: PCT/EP95/03774

§ 371 Date: May 20, 1997

§ 102(e) Date: May 20, 1997

[87] PCT Pub. No.: WO96/10679

PCT Pub. Date: Apr. 11, 1996

[30] Foreign Application Priority Data

Sep. 30, 1994 [DE] Germany ..... 9415846 U

[51] Int. Cl.[6] ..... E05C 1/06

[52] U.S. Cl. ..... 292/160; 292/300; 292/DIG. 51; 292/DIG. 20

[58] Field of Search ..... 292/160, 157, 292/156, 146, 300, DIG. 20, DIG. 33, DIG. 51, 39; 411/119, 187, 259

[56] References Cited

U.S. PATENT DOCUMENTS

| | | | |
|---|---|---|---|
| 718,101 | 1/1903 | Decker | 292/161 |
| 900,794 | 10/1908 | Stoffels | 292/160 |
| 978,963 | 12/1910 | Vance | 49/395 |
| 1,531,321 | 3/1925 | Vance | 292/162 |
| 1,755,580 | 4/1930 | Hasteltine | 292/161 |
| 2,150,851 | 3/1939 | Thompson | 292/DIG. 33 |
| 2,177,005 | 10/1939 | Purtell | 411/259 |
| 3,472,542 | 10/1969 | Hart | 411/119 |
| 3,762,751 | 10/1973 | Little | 292/DIG. 33 |
| 4,309,139 | 1/1982 | Nakae | 411/187 |
| 4,998,757 | 3/1991 | Ramsauer | 292/160 |

FOREIGN PATENT DOCUMENTS

| | | | |
|---|---|---|---|
| 261268 | 9/1986 | European Pat. Off. . | |
| 2044334 | 6/1972 | Germany | 292/DIG. 33 |
| 4210586 | 10/1993 | Germany . | |
| 9415049 | 7/1994 | WIPO . | |

*Primary Examiner*—Darnell M. Boucher

[57] ABSTRACT

A rod-type closure for locking switch cabinet doors or like doors or flaps comprises a flat strip rod which is arranged so as to be guided parallel to a door edge, arranged in a bevel space, and having at least one locking part arranged thereon. The closure further comprises a closure element arranged on a door frame for receiving the locking part such that it locks. It further includes an actuating device for longitudinal displacement of the flat strip rod between an opening position and a locking position. The flat strip rod forming the locking part is offset out of its longitudinal plane along at least a part of its longitudinal extension thereby forming an offset portion. The flat strip profile in or adjacent to the offset portion, together with one of its offset or non-offset narrow edges forming a locking surface over which is engaged a hook part of the closure element arranged parallel to the plane of the flat strip rod.

32 Claims, 5 Drawing Sheets

ROD-TYPE CLOSURE

BACKGROUND OF THE INVENTION

1. Field of the Invention

The invention is directed to a rod-type closure for locking preferably switch cabinet doors or the like doors or flaps, comprising a flat strip rod which is arranged so as to be guided parallel to the door edge, preferably in the bevel space, and has at least one locking part arranged thereon, further comprising a closure element arranged on the door frame for receiving the locking part such that it locks, and with an actuating device for the longitudinal displacement of the flat strip rod between an opening position and a locking position.

2. Description of the Prior Art

A rod-type closure of this kind is already known from EP 0 261 268.

In sheet-metal cabinets with leaf-type cabinet doors which are provided with an angled edge and accordingly form a bevel space, the requirements for the closing action of the rod-type closure are especially high because such doors have only limited stability. Cabinet doors of this type can warp and deform under certain conditions. Moreover, these doors are exposed to particularly high stresses in certain applications. For example, when used as doors of electric switch cabinets containing high-voltage switches, arcing can occasionally occur inside the cabinet, resulting in explosive release of arc gases which leads to high pressure loading of the doors.

For this reason it is important that rod-type closures provided for such sheet-metal cabinets are constructed in such a way that they connect the door securely with the body of the cabinet so that the door can also receive the loads mentioned above. In this regard, the shape and bearing of the locking rods with their locking parts deserve particular attention.

According to EP 0 261 268, the flat strip rod has pins making up the locking part, these pins being round in cross section and attached to the flat strip material, for example, by riveting. During the closing process, these pins move into a bracket with a U-shaped section or profile.

In a rod-type closure known from DE 42 10 586 A1 which is similar to the type mentioned above, a 90-degree turn serves as a locking part of the flat strip rod, while a hook-shaped structural component part is used as closure element.

A disadvantage in the first reference cited above consists in its relatively complicated construction which should be simplified while retaining the advantages already achieved. The other reference has the disadvantage that the starting region formed by the turn in the flat strip rod in the locking area causes problems in that the rear engagement formed in this way leads to high friction and accordingly also to high wear and impedes movement during the moving in process. Another disadvantage consists in that the turn extends toward both sides and accordingly results in a relatively broad construction, although only one of these two sides is usable, so that there is an unnecessary waste of space. Further, the rotational loading of the rod is quite extensive, which likewise increases the friction in the rod guides and further increases the forces needed for actuating.

OBJECT AND SUMMARY OF THE INVENTION

It is the primary object of the invention to improve a rod-type closure of the type mentioned above so as to simplify construction and thus provide for more economical manufacture while preventing excessive friction and excessive wear and eliminating difficulties with the insertion movement in a particularly slender and stable construction.

This object is met in that the flat strip rod forming the locking part in the rod-type closure of the type mentioned above is offset out of its longitudinal plane along at least a part of its longitudinal extension, in that the flat strip profile in or adjacent to the offset portion together with one of its narrow edges, either the offset (outer) narrow edge or the narrow edge which is not offset (inner narrow edge), forms the locking surface over which is engaged a hook part of the closure element arranged parallel to the plane of the flat strip rod.

Thus, rather than roller pins with their complicated mounting, the offset or bend serves in this case to lock the locking rod, and accordingly the door connected with it, with the door frame in that the bend moves behind a projection or hook part of the closure element which is supported by the door frame, or to release the locking arrangement between the door and the door frame in that the bend moves into the region of a protuberance or strip projecting in the same direction. In this latter case, an edge lying in the plane of the rod is used for locking so that the rotational loading of the rod is practically eliminated.

According to an advantageous further development of the invention, the flat strip rod is offset in its offset portion by an amount corresponding to one- to two-times the thickness of the flat strip rod. This amount is sufficient to ensure an adequately reliable locking without the rod, including its offset region, and the associated retaining element taking up too much space.

In particular, it is advantageous when the flat strip rod, in its offset portion, is offset out of the plane of the rod in one direction. Alternatively, the offset portion of the flat strip rod can also be offset first in one direction and then in the other, opposite direction, preferably by the same amount in each instance, e.g., by the thickness of the rod. With a suitable construction of the retaining element, this likewise reduces the effect of torque on the flat strip rod because the two lever arms are oppositely directed and cancel each other out.

In accordance with another further development of the invention, one or both narrow sides of the flat strip rod can be constructed with trough-shaped offsets or recesses in the two regions of the bending lines forming the offset. An undercut region is thus formed in the finished bent rod which improves guiding and locking in the retaining element, resulting in particularly large retaining forces, e.g., the closure can be used in switch cabinets with explosive arc discharges.

In accordance with another further development of the invention, the closure element is L-shaped, wherein one of the legs of the "L" serves for fastening the closure element, the other leg of the "L" being constructed at its free end as a hook part which engages over the locking surface of the flat strip rod. According to another further development of the invention, the closure element is outfitted at the free end of its other L-leg serving as fastening with a guide web for one of the broad sides of the locking portion of the flat strip rod.

In a construction of this kind, the guide web of the closure element can have a slanted or curved stop surface in the displacement direction of the flat strip rod (and also vertically thereto).

At least one protuberance or a web can project from the middle region of the fastening leg of the L-shaped closure element in the direction of the trough-shaped recesses of the flat strip rod so as to form an additional guide.

The guidance can be further improved in that a protuberance or web of this kind also projects from the engaging hook part, preferably in exact alignment with the protuberance or web proceeding from the fastening leg of the closure element.

The closure element can also have a U-shaped cross section and can be fastened by the web of the U, while a hook part engaging over the flat strip rod which is guided between the U-legs proceeds from the free ends of the U-legs.

BRIEF DESCRIPTION OF THE DRAWINGS

The invention is explained more fully with reference to embodiment examples which are shown in the drawings.

DESCRIPTION OF THE PREFERRED EMBODIMENTS

Figure 1:
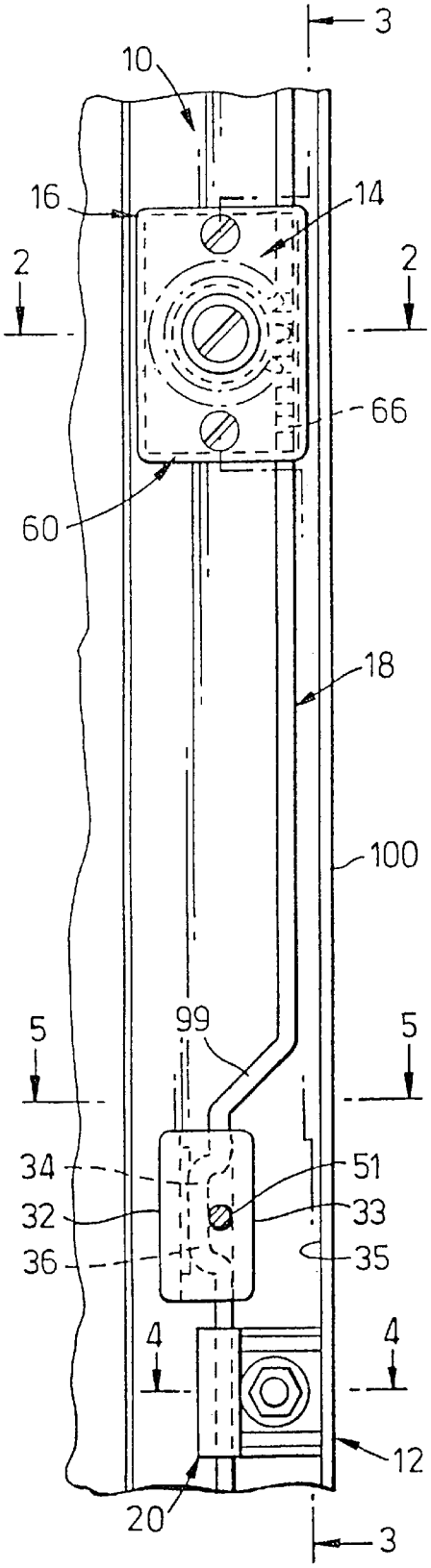
FIG. 1 shows a rear view of the bevel space of a sheet-metal cabinet door with a rod-type closure which is installed in this bevel space and which has a flat strip rod with a locking portion and associated closure element in a first embodiment form of the rod-type closure according to the invention.
Figure 2:
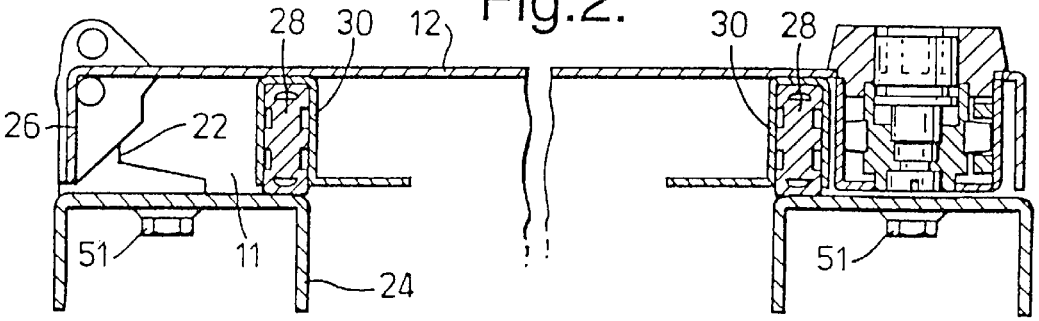
FIG. 2 shows a sectional view along line 2—2 of FIG. 1.
Figure 11:
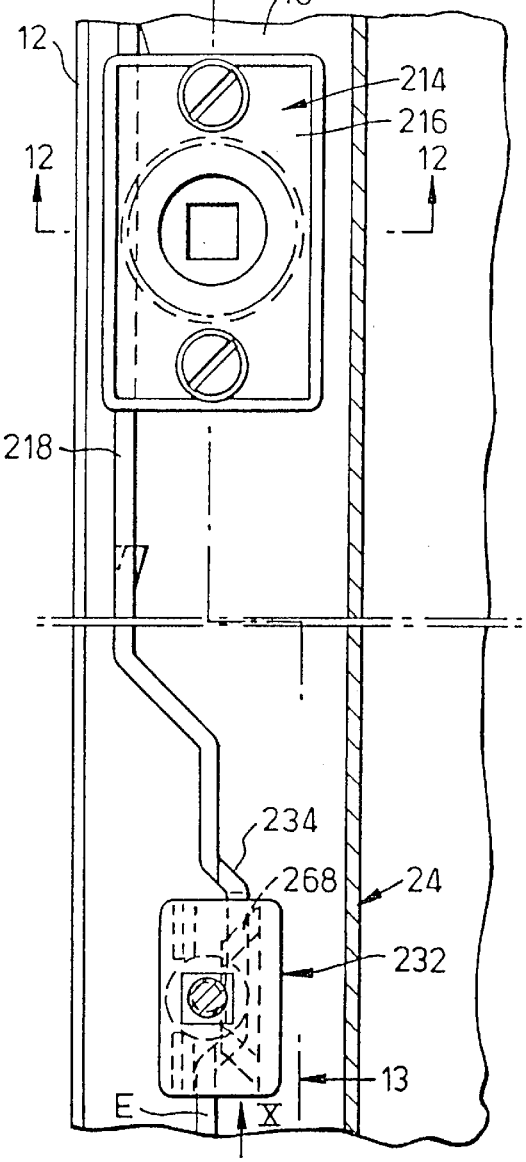
FIG. 11 shows a similar view to that shown in FIG. 1 of a somewhat different construction of the locking rod with modified locking portion and modified associated closure element.

FIGS. 1 and 11 are plan views of the bevel space 10 in a sheet-metal cabinet door 12 showing a rod-type closure 14, 214 which is arranged in this space and which comprises a lock 16, 216 from which proceeds a rod 18, 218 extending in the bevel space 10, this rod 18, 218 being displaceably supported within the lock 16, 216 on one side, but also on the other side at the door leaf 12 in a rod bearing 20. The sheet-metal door 12 is hinged at the cabinet body 24 via joint hinges 22 (see FIG. 2) which, in turn, make use of the other bevel space 11 formed between the outer fold 26 and an inner profile plate 30 which is welded onto the door leaf and receives a seal 28.

Figure 3:
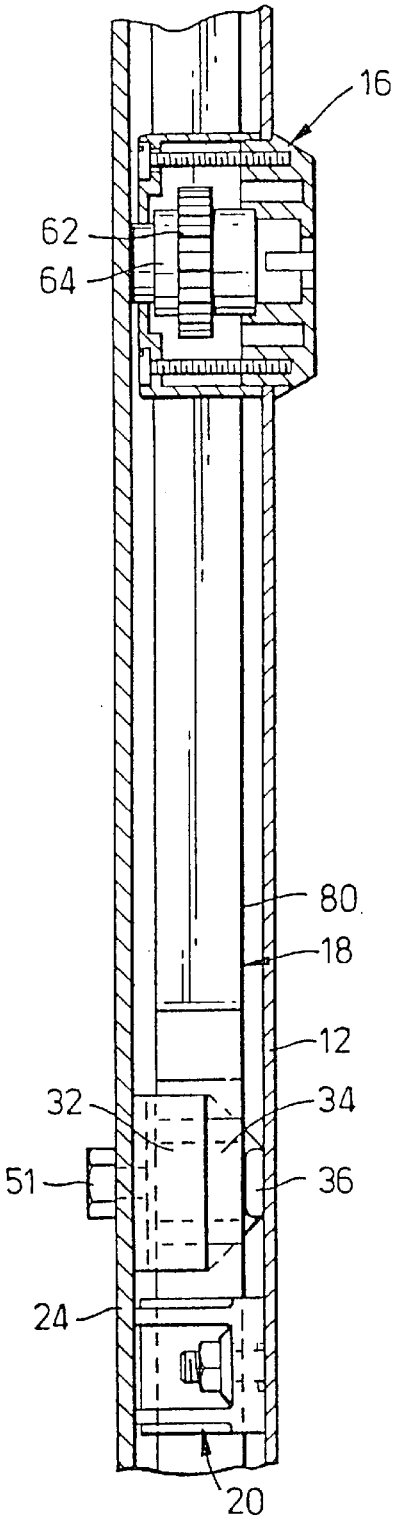
FIG. 3 shows a sectional view along line 3—3 of the FIG. 1.

As will be seen from FIG. 3 which shows a section along line 3—3 in FIG. 1 or from FIG. 13 which shows a section along line 13—13 of FIG. 11, a closure element 32 or 232, which will be described more fully hereinafter, is also located at the cabinet body 24 and penetrates into the offset or bend 34 or 234 formed by the closure rod 18 or 218 and thus secures and locks the door leaf 12 at the cabinet body 24, this door leaf 12 being connected with the rod 18 or 218, e.g., via the guide 20 (see also FIG. 4) and the lock 16 or 216.

Figure 5:
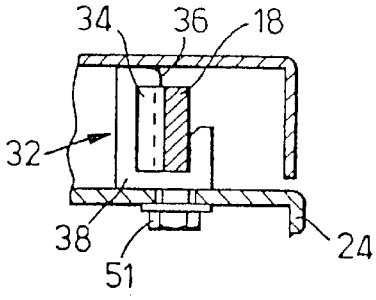
FIG. 5 shows a sectional view along line 5—5 of FIG. 1.
Figure 6A:
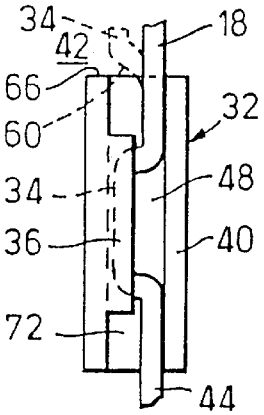
FIG. 6A is a side view and FIG. 6B is a sectional view showing details of the offset portion of the flat strip rod and a closure element fitting the latter in one embodiment form.
Figure 14:
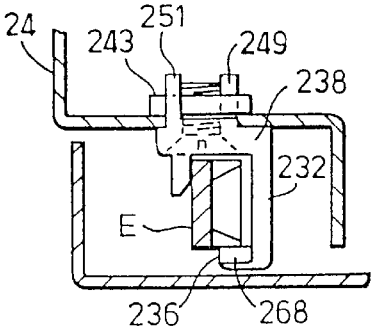
FIG. 14 shows a view similar to FIG. 10 to further illustrate the fastening of the locking part at the door frame.
Figure 23A:
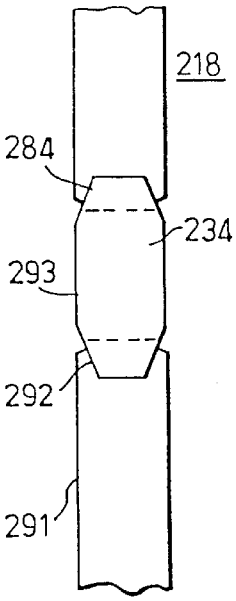
FIGS. 23A and 23B show a locking rod used according to FIG. 14 in two views of the locking region at an offset of 90°.
Figure 23B:
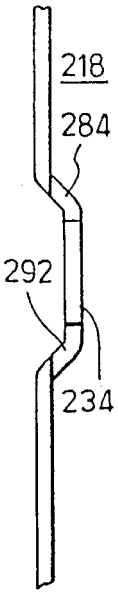

In the sectional view along line 5—5 in FIG. 1 which shows an embodiment form of a closure element 32 (see FIG. 5) and also, for example, in FIG. 6A and an alternative embodiment form 232 with reference to FIG. 14 and FIGS. 23A, 23B it will be seen that the rods 18 or 218 which are rectangular in cross section and are formed by flat strip material lie with an offset or bend 34 or 234 in a closure element 32 or 232, wherein a hook part 36 or 236 which is formed by the closure element 32 or 232 engages over this bent part 34 or 234.

In the embodiment forms shown in FIGS. 5 and 14, the closure element 32 or 232 is substantially L-shaped, wherein one L-leg 38 or 238 serves to fasten the closure element 32 or 232 to the cabinet body 24, e.g., in that this leg 38 has a threaded bore hole into which a fastening screw 51 can be screwed in order to secure the closure element 32, wherein the closure element 32 can also have means for preventing rotation, e.g., in the form of a V-shaped opening in the cabinet body 24, in which corresponding projections of the closure element 32 can be inserted so as to be locked against rotation.

Figure 18A:
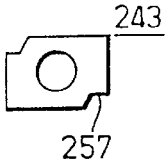
FIG. 18A shows a top view of a fastening nut such as that used in FIG. 14.
Figure 18B:
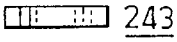
FIG. 18B is a side view of the fastening nut of FIG. 18A.
Figure 19:
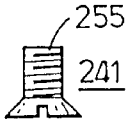
FIG. 19 shows an associated countersink head screw.

In the embodiment form according to FIG. 14, the leg 238 is provided with a countersunk bore hole 239 for a countersink head screw 241 according to FIG. 19, which screw 241 can be screwed into a special nut 243 according to FIG. 18A (top view) and FIG. 18B (side view). The special nut has a rectangular shape with a greater length than width and can be made possible by a corresponding rectangular opening 245 in the door frame region 24 for the purpose of mounting the closure element 232 with inserted screw 241 and attached nut 243.

Figure 16:
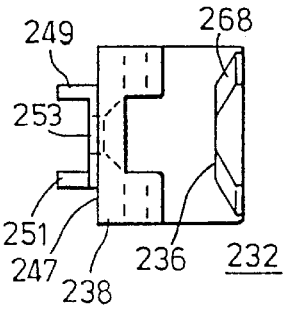
FIG. 16 shows the locking part of FIG. 14 in a side view.
Figure 17:
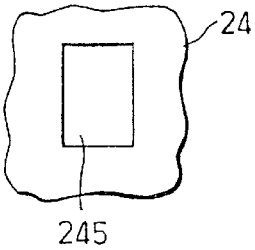
FIG. 17 is a plan view of the fastening opening in the door frame which is suitable for the locking part according to FIG. 15 or 16.
Figure 20:
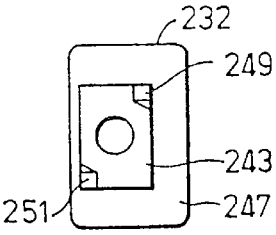
FIG. 20 shows a rear view of the locking part according to FIG. 15 with inserted screw and nut according to FIGS. 18 and 19.
Figure 21:
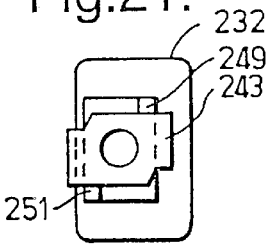
FIG. 21 shows a plan view according to FIG. 20, but after actuation of the nut with screw.

In order to enable a determined alignment of the special nut 243 with respect to the contact surface 247 of the closure element 232 (see FIG. 20), a projection 253 adapted to the opening 245 first projects from this contact surface 247 (FIG. 16). This projection 253 fixes the closure element 232 in the opening 245 and has a height equal to or somewhat less than the thickness of the plate material in which the opening 245 is made. Proceeding from this projection 253, in addition, are two shoulders or protuberances 249, 251 which form stops for the special nut 243 (FIG. 18A) when the screw 241 is turned in the unscrewing direction, whereupon, due to the friction between the screw and the nut which may be reinforced, as the case may be, by a plastic point on the external thread of the screw 241 (see FIG. 19), the nut 243 is turned (FIG. 20) such that it contacts the shoulders 249 with corresponding stop faces 257 and, in so doing, is aligned in such a way that in this position the closure element 232 with protuberances 249, 251, nut 243 and projection 253 can project through the opening 245 in the housing or frame 24. After being inserted, the screw 241 is turned in the clockwise direction (screwed in) by a screwdriver or the like tool so that the nut 243 is first turned by 90° into the position shown in FIG. 21 due to the friction between the screw and nut and the free movability of the nut 243 behind the sheet-metal panel of the door frame 24. In this position, the nut again stops at the projections 249 and 251 and the screw 241 can now be tightened in the nut 243 by continued turning, whereupon the parts of the nut 243 contacting the rear of the sheet-metal panel secure the closure element 232 as can be seen in FIG. 14.

Figure 22A:
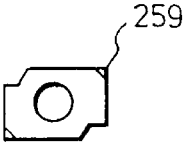
FIGS. 22A and 22B show a nut with fitted tips.
Figure 22B:
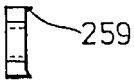

According to FIG. 22A and FIG. 22B, this special nut can also have projections or pointed teeth 259 which face in the direction of the fastening surface of the door frame 24 and dig into the material of the door frame 24 when the screw 241 is tightened, e.g., so as to provide an additional securing effect preventing the nut 249 from loosening by itself when the closure is operated, but which serve especially to ground the nut if the sheet-metal cabinets are painted in that the teeth penetrate through the paint to the metal surface.

The embodiment form described above accordingly provides for a simplified assembly, since the closure element 232 can be supplied together with inserted countersink head screw 241 and attached special nut 243 and this structural component part can simply be inserted through a corresponding rectangular opening 245 in the door frame or the like and the fastening screw 241 can then be rotated until tightened. In so doing, the closure element 232 is automatically aligned by its projection 253 and the special nut 243 is then rotated into its locking position and tightened by actuation of the screw 241. This signifies a considerable simplification of assembly and no structural component parts can get lost.

Figure 4:
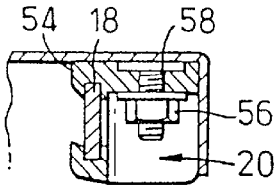
FIG. 4 shows a sectional view along line 4—4 of FIG. 1.

A possibility for guiding the flat strip rod is shown in the sectional view 4—4 from FIG. 1 (see FIG. 4). This rod guide is formed of plastic and is arranged in the corner space of the bevel space 10 so as to be fixed with respect to rotation by means of a stay bolt arrangement 58 and is so constructed that the flat strip rod 18 can be inserted into the guide laterally by bending away a projection or protuberance 54 beforehand, whereupon the fastening nut 56 of a welded bolt, for example, is tightened so that the protuberance 54 presses against the rod 18 so as to secure it. When the forces to be absorbed are greater, a two-part metal rod guide can also be used.

FIGS. 3, 4, 13 and 14 show that the lock 16 or 216 serves simultaneously to drive the flat strip rod 18 or 218 and as a rod bearing, so that an additional rod bearing such as is shown at reference number 20 in FIG. 1 can now be dispensed with. The rod is driven by the teeth of a pinion 62 or 262 which engage in corresponding perforations 66 in the center of the rod, this pinion 62 or 262 making up part of a lock nut 64 or 264 which is, in turn, rotatable by means of an actuating device such as a handle, swivel lever, plug-in lock or the like which is guided out through the door leaf 12. The pinion 62 or 262 slides the rod 18 or 218 up or down when rotated by means of its engagement in the perforations or teeth 66 of the rod 18 or 218.

Different embodiment forms 32, 132, 232, 332, 432 of the closure element and associated offset 34, 134, 234, 334, 434 of the flat strip rod 18, 118, 218 will now be discussed more fully. This closure element is preferably arranged near rod guides 20 (see FIG. 1) in order that the lever arm between the guide 20 and the lock, e.g., 42, formed by the closure element and the associated bend or offset, e.g., 34, can be made as small as possible so that the bending load of the flat strip rod, e.g., 18, is accordingly as small as possible.

Figure 6B:
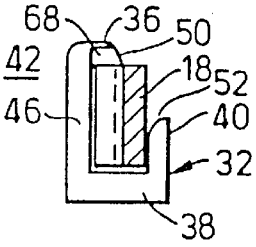

A first embodiment form of a closure element 32 of this kind is shown in a side view in FIG. 6A and in a view in cross section in FIG. 6B, wherein the embodiment form shown in FIGS. 6A and 6B is similar to that shown in FIGS. 1 to 5. It is noted in addition that the closure element 32 at the free end of an L-leg 38 which is fastened to the door frame serves a guide web 40 for one broad side 44 of the rod portion of the flat strip rod 18 adjoining the bent region 34. This guide web 40 prevents the rod 18 from bending away from the leg 46 of the closure element 32 and thereby disengaging from the hook part 36. This lock is extremely stable and exerts a shearing load and bending load on the rod principally in its larger cross-sectional extension, while the load in the smaller cross-sectional extension and the rotational load remain small because the corresponding corners, protuberances and guide strips all lie very close to the longitudinal axis of the rod and the lever arm lengths remain small.

Accordingly, the bent portion 34 will not be released until, for example, the rod 44 is displaced, e.g., upward, into a position shown in dashed lines in FIG. 6A by means of the actuation of actuating means, not shown. The region of the hook part 36 which is not bent, as shown in FIG. 6B, can now slide past in an upward direction and the door leaf can accordingly be swiveled away from the door frame. When the door is closed again, the region which is not bent penetrates again into the slot 48 formed between the end face of the hook part 36 and the guide web 40, wherein this penetration is facilitated, especially when the flat strip rod 18 and closure element 32 are not precisely aligned with one another, in that the hook part 36 has a slope 50 and the guide web 40 has a slope 52 which together form a kind of funnel. When the rod reaches the position shown in FIG. 6B, the rod 18 can be moved down again, e.g., via the lock 16 (FIG. 1), according to FIG. 6A, wherein a diagonal surface 60 of the beginning of the bend 34 could also serve to facilitate the running in movement at the edge 66 when the bent region 34 is situated completely outside of the closure element 32. The underside 70 of the hook part 36 or 136 (see FIG. 7C) could have another diagonal surface 68 so that if the door is not completely pushed closed, e.g., owing to the sealing material 28, it can be ensured that the bend 34 or 134, when moving in, will not be blocked by the end face of the hook 36 or 136, but rather will slide on the diagonal surface 68 and, in so doing, will press the locking rod 18 or 118 into the closure element 32 or 132 and will accordingly pull the door closed. The movement is continued until the position of the locking rod 18 shown, e.g., in FIG. 6A is reached with respect to the retaining element 32, in which position the closure element 32 is loaded substantially centrally, so that ability to absorb forces is maximized when the closure element 32 is fastened by a central screw (according to FIG. 1) or, for instance, by two side screws (in areas 72 shown in FIG. 6A) at the cabinet body 24.

As can further be seen from FIG. 6A, the extension of the hook part 36 is somewhat less than that of the other parts of the closure element 32, namely especially the two L-legs 38 or 46 and the guide web 40. As a result of this step, the necessary movement path of the locking rod 18 for opening and closing is shorter while retaining substantially the same stability and guiding accuracy.

Figure 7A:
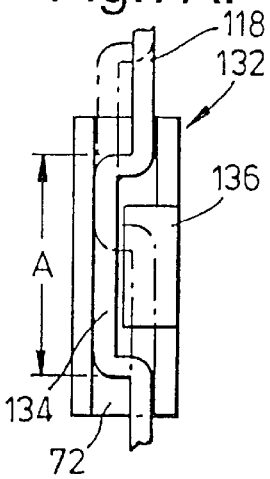
FIGS. 7A, 7B and 7C show another embodiment form in corresponding views and in another view from the top.
Figure 7C:
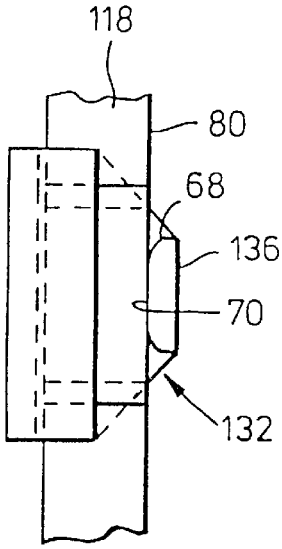
Figure 7B:
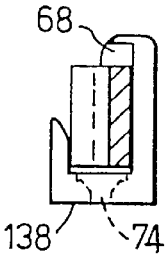

While the embodiment form according to FIGS. 6A and 6B operates in such a way that the door can be opened when the locking rod 18 moves out of the position shown in solid lines either upward or downward, the embodiment forms shown in FIGS. 7A, 7B and 7C work in exactly the opposite way: when the locking rod 118 which is constructed identically in all other respects is located in a middle position indicated by solid lines, this locking rod 118 is so disposed that the bent area 134 moves past the hook part 136 when the door leaf is swiveled open or closed with respect to the door frame. On the other hand, if the rod 118 is displaced upward or downward (see the dashed lines) the part of the rod 118 which is not bent moves under the hook part 136 and it is no longer possible to open the door. In this embodiment form, the longitudinal extension of the hook part 136 is somewhat smaller than in the embodiment form according to FIGS. 6A and 6B, just as, conversely, the axial extension of the bent region 134 is somewhat greater. Consequently, the accuracy of the displacement of the locking rod 118 does not need to be as exact in order to reach the open area. However, the closure elements 32 or 132 are identically constructed in other respects, including the stop surfaces, mentioned above, for facilitating the closing process in the event of imprecise alignment of the closure rod 118 or 18 with respect to the closure element 132 or 32.

In addition, it is noted that the shorter axial extension of the hook part 36 or 136 as compared with the total extension of the closure element 32 or 132 results in surface regions 72 which are accessible from above and which make it possible to provide countersunk bore holes 74 (FIG. 7B) for fastening screws with countersink heads, thus enabling fastening screws to be fitted from above also, in contrast to the arrangement according to FIGS. 1 and 5. A countersunk bore hole of this kind is designated by reference number 74 in FIG. 7B. Since there are two such surfaces 72, two fastening screws can be provided in a simple manner, which additionally secures the closure element 32 or 132 with respect to rotation.

Figure 10:
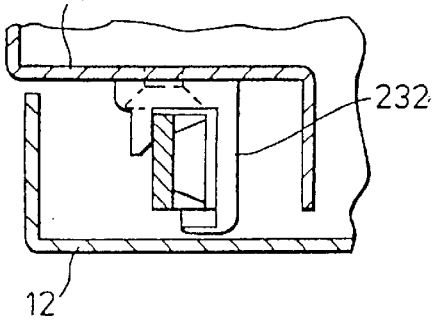
FIG. 10 shows a sectional view similar to that in FIG. 5 along the line of sight X in FIG. 11.
Figure 12:
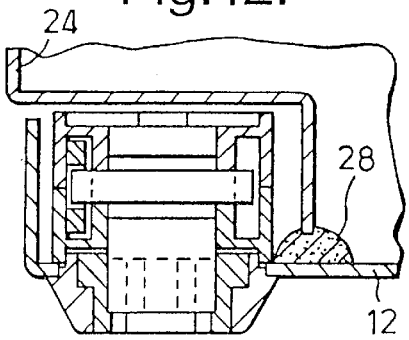
FIG. 12 shows a side view along line 12—12 in FIG. 11.
Figure 13:
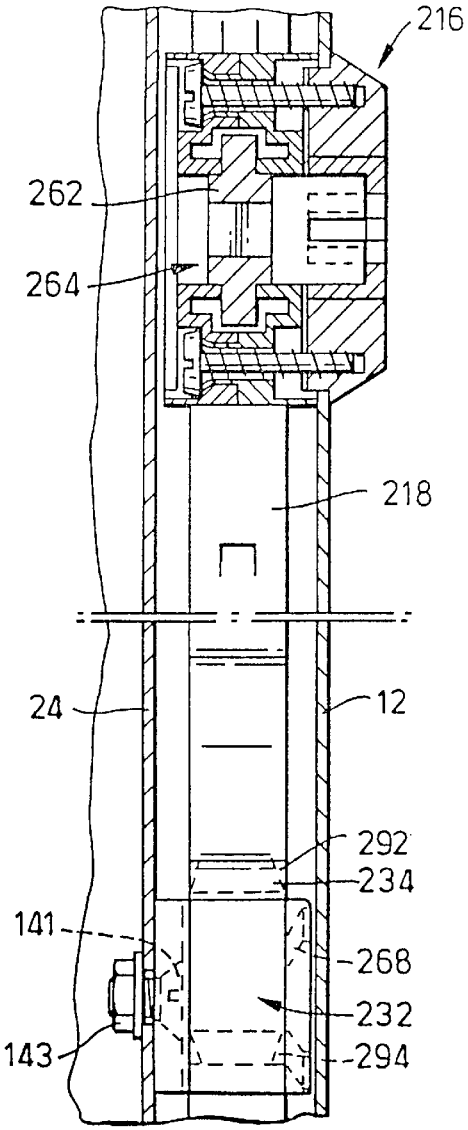
FIG. 13 shows an axial sectional view along section line 13—13 of FIG. 11.

FIG. 10 shows an embodiment form for a closure element 232 which is provided for single-hole fastening and, as shown in FIG. 13, can be fastened with a countersink head screw 141 with a standard nut 143 or, as is shown in FIGS. 15 to 22, by means of a special fastening which has already been described above.

The closure element 232 has diagonally extending stop faces 268 with which the bent regions 234 of the locking rod 218 cooperate, thus facilitating the moving in of the bent region. It is significant that both here and in the other embodiment forms the fastening axis of the screw 141 and nut 143 is exactly flush with the axis E of the locking rod (outside of its bent regions) so that no torque acts on the locking rod 218 as a whole when it receives closing forces, only the lever arm caused by the bend plays a part. Another advantage consists in that the locking rod can be turned about its longitudinal axis by 180° (e.g., for the purpose of changing the actuating device), which under certain conditions may require rotating the closure element (e.g., 232), but does not require alteration of the fastening—since the rotation does not change the position of the fastening screw (e.g., 141, 241).

The improved fastening shown in FIGS. 15 to 22 has the further advantage that the fastening can also be effected when the interior of the switching cabinet, that is, the surface on which the special nut 243 according to FIG. 14 comes to rest, is inaccessible or only poorly accessible when assembling the closure element 232. The reason for this is that the closure element with its projections 249, 251, 253, including the screw 241 and special nut 243, can be inserted through the opening 245 from the outside, whereupon the screw 241 which is also accessible from this side is turned and the entire arrangement can be secured as was already described above. In this case, also, the axis of the screw 239 advisably lies exactly in the axial line E of the locking rod.

Figure 24A:
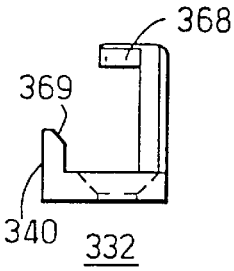
FIGS. 24A, 24B and 24C show three different views of a locking part of a somewhat different construction with two fastening holes.
Figure 24B:
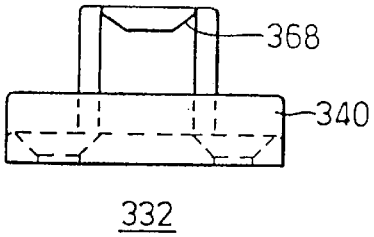
Figure 24C:
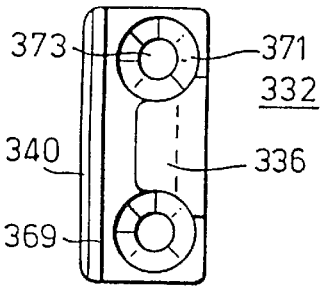

If particularly high stability is desired, fastening can also be effected by means of two openings in the closure element 332 and by using two countersink head screws as is shown in FIGS. 24A, 24B and 24C. In other respects, the construction of the locking element 332 shown in these figures is similar to that of the arrangement according to FIG. 10, again with stop bevels 368 and another diagonal surface 369 at the end of the guide web 340 which is intended to facilitate the moving in of the locking rod when the door is closed. The fastening is effected in this case by means of two countersink head screws with accompanying conventional nuts as can be seen, for example, in FIG. 13.

Since the hook region 336 according to FIG. 24C is set back to the extent that the countersinks 371 receiving the countersink screw heads remain freely accessible so that a tool such as a screwdriver can be applied, the associated bore holes 373 can be situated such that their center point is flush with a line below the hook 368 (in contrast to FIGS. 14, 15). The axial plane of the locking rod running in at this closure element 332 can be oriented such that no turning forces are exerted on the locking rod when locking is effected in such a way that the region of the locking rod which is not bent serves for locking purposes, while the bent region is the region releasing the locking rod in the open position of the closure. This is discussed more fully hereinafter with reference to FIG. 7A.

Figure 15:
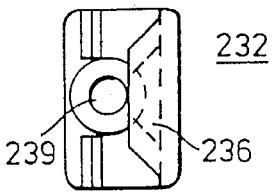
FIG. 15 shows the locking part of FIG. 14 in a top view.

This is to be viewed in contrast to the fact that in the embodiment form according to FIGS. 14, 15 the axis of the opening 239 shown in the drawing is located farther away from the hook 268 and is therefore suitable for rods which lock with their bent region and whose normal region which is aligned with the opening 239 is located outside of the hook arrangement 236.

The arrangement according to FIGS. 24A, 24B and 24C is accordingly somewhat narrower, but somewhat shorter in exchange, while the arrangement according to FIG. 12 or 13 or FIGS. 14 to 16 is somewhat shorter, but slightly wider in exchange.

While the narrow sides of the closure rod 18 or 118 shown in FIGS. 6 and 7 lie in a plane, this is not the case in the closure rod 218 shown in FIGS. 23A and 23B. In this case, the bent region is pressed in such a way that diagonal stop surfaces 284, 292 are formed which begin at an offset relative to the narrow edge plane 291 of the part of the locking rod 218 which is not bent and terminate in a plane 293 which is aligned with plane 291.

Figure 8A:
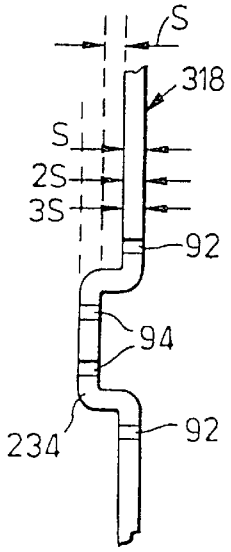
FIGS. 8A and 8B and 8C show corresponding views of another embodiment form.
Figure 8B:
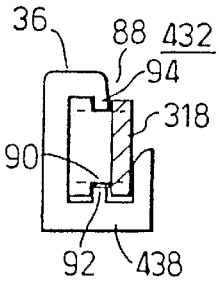
Figure 8C:
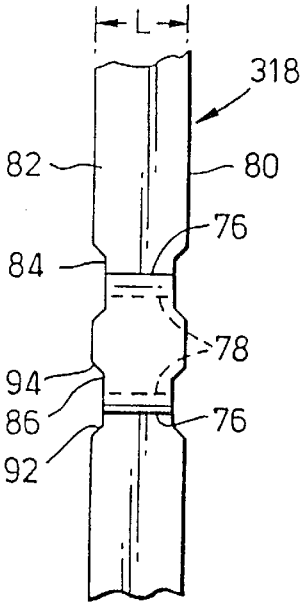

In the embodiment form shown in FIGS. 8A, 8B and 8C, the flat strip rod 318 has a construction similar to that of the rod 18 or 118 in FIGS. 6 and 7, but has, in addition, trough-shaped recess regions 84 or 86 which are worked into the region of the two bending lines 76, 78 forming the offset in the narrow sides 80, 82. In this case, the recess regions 84 or 86 are arranged on both sides so that the configuration shown in FIG. 8C appears axially symmetrical along the transverse axis as well as along the longitudinal axis. An additional guide channel 88 or 90 (see FIG. 8B) is formed by these recesses 84, 86 which can be produced easily by means of a stamping process. This guide channel 88 or 90 is preferably formed in such a way that it has the same width as that corresponding to the material thickness S of the flat strip rod 318, which can be achieved in that the bend is effected from out of the plane of the flat strip rod by a magnitude 2S (see FIG. 8A) so that the overall width of the arrangement (rod with bend) amounts to 3S.

Due to this guide channel 88 or 90, it is possible to provide the locking means with even greater stability, wherein a protuberance or web 92 directed toward the trough-like recess of the flat strip rod preferably projects from the middle region of the fastening leg 438 of the closure element 432 (FIG. 8B). Another protuberance or web 94 oriented to the engaging hook part 436 can also project from the latter 436. In addition to the increased stability in the arrangement overall as a result of these additional guides, there are also stop surfaces 92, 94 which facilitate the moving in of the narrow sides 80, 82 either in the region which is not bent (similar to FIG. 7) or in the bent region (similar to FIG. 6).

Figure 9A:
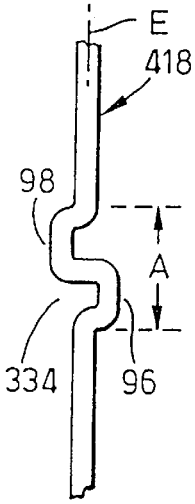
FIGS. 9A and 9B show corresponding views of another embodiment form.
Figure 9B:
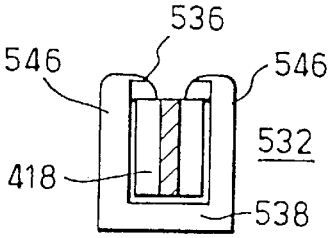

Finally, reference is had to FIGS. 9A and 9B in which the locking rod 418 is offset first in one direction 96 and then in the other opposite direction 98, preferably by the same amount, along its offset portion A. In the illustrated embodiment form, this amount corresponds approximately to the rod thickness. The overall width of such an arrangement is again approximately three-times the thickness S of the flat strip rod, that is, 3S in this case, so that the width of an associated closure element 532 according to FIG. 9B substantially corresponds to that of the embodiment form of FIG. 8B. This closure element 532 has a substantially U-shaped cross section, wherein the web 538 of this cross section serves as a fastening surface, while a hook part 536 projects inward from each of the free ends of the U-legs 546, behind which hook part 536 the respective bent part 96 or 98 can lie when the closure is moved into its locking position, since the rod is supported at both sides in this case insofar as the hook parts 536 of the closure element extend over distance A.

The advantage of this arrangement consists in its extensive symmetry which makes it possible to use the rod elsewhere without changing the ratios or proportions. Another advantage is that the locking rod is not torsionally loaded.

Figure 25:
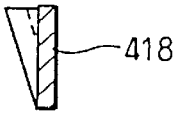
FIG. 25 shows an alternative configuration of the locking rod.

Instead of a complete bend along the entire cross-sectional length (FIG. 8C), it can suffice to bend out only one upper (with reference to FIG. 6B) end of the rod 418 on one side in such a way that a bend is formed only at the upper end and this bend decreases to zero again at the lower end of the cross-sectional extension (see FIG. 24). Such a shape could easily be used in a closure element according to FIG. 6B, for example. FIG. 25 shows an alternate configuration of the locking rod 418.

The bend 99 shown in FIG. 1 can be omitted if the rod 18 is guided at a constant distance from the fold or bevel 100 of the door leaf 12, which is made possible, for example, by another arrangement or another design of the rod guide 20. The closure element 32 fastened to the door frame would then also be brought closer to the bevel 100 of the door leaf 12, e.g., until the surface 33 of the closure element 32 contacted the inner surface 35 of the bevel 100 enabling an additional guiding of the door leaf with respect to the door frame.

As a whole, not only is production simplified compared with the prior art, but the arrangement is also much more compact and can be accommodated in a narrower space. Because of the narrowness, the lever arms of the lock are also smaller, which increases the ability to absorb forces while retaining the same material thickness.

A particular advantage of the constructions of the closure element according to FIGS. 14 to 16, as well as the construction according to FIGS. 24A, 24B and 24C in connection with the locking rod according to FIGS. 23A and 23B is the fact that the bent profile (see, e.g., FIG. 23B) is adapted to the profile of the hook 263 of the closure element 232 according to FIG. 15 as viewed from the top (this is realized with slightly less exactitude in the closure element 332 according to FIG. 24C).

Due to this construction, the closure rod 218 can operate in such a way that when oriented in a manner similar to that shown in FIG. 7A it causes the door to be open in a middle position, but causes the door to be locked in a position above or below the latter. When the rod 218 is rotated by 180° along its longitudinal axis, the position according to FIG. 6A results in which the door is locked in the middle position and is open in a position above or below the middle position. Both modes of operation can be achieved with the same closure element as that shown in FIGS. 14 to 16, for example.

Instead of rotating the locking rod 218 by 180° around the longitudinal axis for the purpose of changing operation, the closure element 235 can also be turned 180° about an axis parallel to the axis of its fastening screw in order to achieve the same effect.

This possibility of reversing operation is especially attractive in swivel lever closures in which the swivel lever can be locked, e.g., in a horizontal position and in two vertical positions opposite one another, wherein these three positions of the swivel lever are tied to a middle position of the bend of the locking rod with respect to the closure element and to a position below and above this position, e.g., see PCT publication WO 94/15049 of the present Applicant. Thus, simply by turning the locking rod, for example, the middle position of the handle can be switched from an open position of the closure to a closing position and vice versa.

On the other hand, this switchability which is made possible by the invention is not provided in DE 42 10 586 A1, for instance. When the locking rod used in this reference is rotated 180° about its longitudinal axis, there is no change in the geometrical arrangement and accordingly no change in function.

The invention is commercially applicable in a variety of environments such as switch cabinet construction, for example.

While the foregoing description and drawings represent the present invention it will be obvious to those skilled in the art that various changes may be made therein without departing from the true spirit and scope of the present invention.

What is claimed is:

1. A closure for locking a door, comprising:

a flat strip rod arranged so as to be guided parallel to a door edge, said flat strip rod including thereon an offset rod portion not in a longitudinal plane of said flat strip rod but remaining within a second plane of said flat strip rod extending along a width of said flat strip rod, said offset rod portion defining a locking part of said flat strip rod, and a portion of said flat strip rod in or adjacent to the offset rod portion, together with an edge of said portion, forming a locking surface;

a closure element arranged on a door frame for receiving said locking part, said closure element including a hook part arranged parallel to the longitudinal plane of the flat strip rod; and an actuating device for longitudinally displacing said flat strip rod between an opening position and a locking position, said hook part of the closure element engaging the locking surface of said flat strip rod when said flat strip rod is in said locking position.

2. The closure according to claim 1, wherein the offset rod portion of said flat strip rod is offset from a non-offset portion of said flat strip rod by an amount corresponding to one to two times a width of the flat strip rod.

3. The closure according to claim 2, wherein the offset rod portion of the flat strip rod is offset from the non-offset portion in one direction.

4. The closure according to claim 2, wherein the offset rod portion of the flat strip rod is first offset from the non-offset portion in a first direction and then is offset from the non-offset portion in a second direction equal and opposite to the offset in the first direction.

5. The closure according to claim 3, wherein the flat strip rod includes therein at least one narrow side and said at least one narrow side of the flat strip rod forms at least one trough-shaped recess in at least one portion of a bend in said flat strip rod that forms the offset rod portion.

6. The closure according to claim 1, wherein the closure element is L-shaped with two L-legs, and one L-leg of the L-shaped closure element operates to fasten the closure element and the other L-leg is formed at its free end as a hook part which engages over the locking surface of the flat strip rod.

7. The closure according to claim 6, wherein said L-leg that operates to fasten the closure element includes thereon a guide web for receiving a broad side of the locking part of the flat strip rod.

8. The closure according to claim 7, wherein the guide web has a slanted or curved stop surface slanted or curved in a direction corresponding to a direction of movement of the flat strip rod.

9. The closure according to claim 7, wherein the guide web has a slanted stop surface slanted in a direction that is vertical to an axis of the flat strip rod.

10. The closure according to claim 6, wherein the closure element includes at least one protuberance or web projecting therefrom in a direction of said at least one trough-shaped recess of the flat strip rod.

11. The closure according to claim 10, wherein said hook part of said closure element includes a projecting protuberance that is aligned with said protuberance or web projecting from the closure element.

12. The closure according to claim 4, wherein the closure element has a U-shaped cross section and is fastened by a web of the U-shaped cross section, and a hook part engaging over the flat strip rod which is guided between U-legs of the U-shaped cross section proceeds from free ends of the U-legs.

13. The closure according to claim 3, wherein the flat strip rod includes an offset area at the start of a bend in said flat strip rod and a surface of said offset area ascends from said flat strip rod at said bend.

14. The closure according to claim 1, wherein the closure element includes at least one shoulder in a region of said closure element that receives a fastening screw for aligning the closure element in an opening in a fastening surface.

15. The closure according to claim 14, wherein the closure elements includes two shoulders for limiting rotational movement of a fastening nut that receives the fastening screw.

16. The closure according to claim 15, wherein the fastening nut has an elongated shape adapted to the opening in the fastening surface and adapted to fit through the opening in one direction, but not in another direction at an offset relative to the opening.

17. The closure according to claim 16, wherein the fastening screw, when tightened, turns the fastening nut in a second direction in which it is secured by the two shoulders.

18. The closure according to claim 13, wherein openings for receiving fastening screws are aligned with the longitudinal plane of the flat strip rod in a non-offset portion of said flat strip rod.

19. The closure according to claim 1, wherein a lateral profile of the offset space formed by the offset rod portion has a shape similar to a truncated roof shape or is only slightly larger than the outer profile of the hook part of the closure element.

20. The closure according to claim 1, wherein a profile of the offset rod portion recedes by a thickness of the flat strip rod in the transition from the portion of the flat strip rod which is not offset to the offset part of the flat strip rod and then increases continuously until achieving the original thickness.

21. The closure according to claim 1, wherein the closure element has at least one countersunk bore hole for receiving a fastening screw whose axis is aligned with the longitudinal axis of the part of the flat strip rod which is not offset.

22. The closure according to claim 21, wherein the closure element forms an alignment projection in the region of a fastening surface of the closure element, which alignment projection cooperates with a recess or opening at a surface at which the closure element is to be fastened.

23. The closure according to claim 22, wherein the closure element has, in the region of the projection, a bore hole for a fastening screw which is screwed into a radially elongated nut which fits through a corresponding opening in the fastening surface in at least one direction and does not fit through in at least one other direction.

24. The closure according to claim 23, wherein the fastening screw has a friction-increasing device in the area of the thread.

25. The closure according to claim 23, wherein the nut has teeth on one contact face.

26. The closure according to claim 25, wherein the nut has recesses in its lateral edges for receiving shoulders of the closure element.

27. The closure according to claim 1, wherein a bore hole for fastening the closure element lies outside an alignment area of the hook part of the closure element, or in that the hook part recedes in the region of the bore and thus affords access to the head of a fastening screw for a tool such as a screwdriver.

28. The closure according to claim 7, wherein the guide web has a curved stop surface curved in a direction that is vertical to an axis of the flat strip rod.

29. The closure according to claim 6, wherein at least one web projects from the middle region of the fastening leg of the closure element in the direction of the trough-shaped recesses of the flat strip rod.

30. The closure according to claim 10, wherein a web also projects from the engaging hook part so as to be aligned with said protuberance or web projecting from the closure element.

31. The closure according to claim 1, wherein the closure element forms an alignment projection in the region of a fastening surface of the closure element, which alignment projection cooperates with an opening at the fastening surface at which the closure element is to be fastened.

32. The closure according to claim 1, wherein the hook part recedes in the region of the bore hole and thus affords access to the head of a fastening screw for a tool such as a screwdriver.

* * * * *